US008991281B2

(12) United States Patent
Kleifgen et al.

(10) Patent No.: US 8,991,281 B2
(45) Date of Patent: Mar. 31, 2015

(54) ADJUSTABLE FOOT PEDAL, LINKAGE, AND METHOD FOR ACTUATING A HYDRAULIC CYLINDER

(71) Applicant: SPX Corporation, Charlotte, NC (US)

(72) Inventors: John Kleifgen, Apple Valley, MN (US); Jose Barrios, Owatonna, MN (US)

(73) Assignee: Bosch Automotive Service Solutions Inc., Warren, MI (US)

( * ) Notice: Subject to any disclaimer, the term of this patent is extended or adjusted under 35 U.S.C. 154(b) by 127 days.

(21) Appl. No.: 13/661,995

(22) Filed: Oct. 26, 2012

(65) Prior Publication Data

US 2013/0104695 A1 May 2, 2013

Related U.S. Application Data

(60) Provisional application No. 61/552,804, filed on Oct. 28, 2011.

(51) Int. Cl.

| | |
|---|---|
| ***G05G 1/04*** | (2006.01) |
| ***G05G 1/48*** | (2008.04) |
| ***B66F 5/04*** | (2006.01) |
| ***B66F 3/00*** | (2006.01) |
| ***B66F 3/24*** | (2006.01) |
| ***G05G 1/30*** | (2008.04) |

(52) U.S. Cl.
CPC ... *G05G 1/30* (2013.01); *B66F 5/04* (2013.01)
USPC ..... 74/518; 74/562; 254/2 B; 254/134; 254/93 R

(58) Field of Classification Search
CPC ..... G05G 1/30; G05G 1/48; B66F 5/04
USPC ..... 74/478, 512, 513, 514, 516, 518, 519, 74/520, 522, 560, 562, 562.5, 563, 564; 254/2 B, 134, 93 R, 89 H; 296/75; 280/291
IPC ..... G05G 1/30, 1/44, 1/445, 1/483, 1/487
See application file for complete search history.

(56) References Cited

U.S. PATENT DOCUMENTS

| | | | | |
|---|---|---|---|---|
| 3,303,720 | A * | 2/1967 | Jaulmes | 74/594.7 |
| 3,307,425 | A * | 3/1967 | Sykes et al. | 74/594.7 |
| 3,811,339 | A * | 5/1974 | Konzorr | 74/594.4 |
| 4,591,179 | A * | 5/1986 | Nakamura | 280/291 |
| 6,561,487 | B2 * | 5/2003 | Siglock | 254/134 |

* cited by examiner

*Primary Examiner* — Thomas R. Hannon
*Assistant Examiner* — Adam D Rogers
(74) *Attorney, Agent, or Firm* — Baker & Hostetler LLP

(57) ABSTRACT

A foot actuated pivoting lever is provided. The lever may include: a lever member having two ends, one end configured to attach to a mechanism configured to receive an input from the lever member; and a pedal pivotally attached proximate to the other end of the lever member, wherein the pedal is configured to pivot between a first and a second position, wherein in the first position, the pedal lies on top of a section of the lever member and, in the second position, the pedal extends beyond the lever member. A mechanism for actuating a piston may be provided.

4 Claims, 8 Drawing Sheets

ADJUSTABLE FOOT PEDAL, LINKAGE, AND METHOD FOR ACTUATING A HYDRAULIC CYLINDER

CROSS REFERENCE TO RELATED APPLICATIONS

This application claims benefit of U.S. Provisional Application No. 61/552,804, entitled "ADJUSTABLE FOOT PEDAL, LINKAGE, AND METHOD FOR ACTUATING A HYDRAULIC CYLINDER," which is hereby incorporated by reference in its entirety.

FIELD OF THE INVENTION

The present invention relates generally to transmission jacks. More particularly, the present invention relates to a foot pedal and foot actuated mechanism for actuating a hydraulic piston pump in a transmission jack.

BACKGROUND OF THE INVENTION

Automobiles and other vehicles need to be serviced from time to time. One complex portion of an automobile or other vehicle that needs servicing is the transmission. The transmission is a heavy component and often is serviced with the aid of a transmission jack, which can support the weight of the transmission. A transmission jack can be used to install or remove a transmission. Furthermore, the transmission jack maybe used to support the transmission while the transmission is being worked on.

Transmission jacks are often hydraulic. A foot pedal may be used to actuate a hydraulic cylinder to provide the hydraulic pressure. One problem with current foot pedal mechanisms used for operating hydraulic cylinders is that some foot pedal mechanisms are not able to generate enough hydraulic pressure to lift the transmission to certain heights. Another problem is that the pump piston may experience seal failures contributed to shear forces put on the piston. These shear forces may be inherent with four bar mechanisms which are typically used to actuate the piston.

Accordingly, it is desired to provide a method and apparatus that can better lift heavier loads and also increase piston seal durability by reducing the shear load on the pump piston by reducing or eliminating shear forces imparted on the piston from the mechanism actuating the piston.

SUMMARY OF THE INVENTION

The foregoing needs are met, to a great extent, by the present invention. In one aspect, an apparatus is provided that, in some embodiments, a method or apparatus is provided that can provide additional mechanical advantage in order to lift heavier loads. Further, the method and apparatus in some embodiments may increase piston seal durability by reducing shear loads imparted onto the piston pump from the inputting mechanism.

In accordance with one embodiment of the present invention, a foot actuated pivoting lever is provided. The lever may include: a lever member having two ends, one end configured to attach to a mechanism configured to receive an input from the lever member; and a pedal pivotally attached proximate to the other end of the lever member, wherein the pedal is configured to pivot between a first and a second position, wherein in the first position, the pedal lies on top of a section of the lever member and, in the second position, the pedal extends beyond the lever member.

In accordance with another embodiment of the present invention, a mechanism for actuating a piston may be provided. The mechanism may include: an input lever; an input bracket attached to the lever; a fixed bracket pivotally connected to the input bracket; a connecting link pivotally connected to the fixed bracket; a rocker link pivotally connected to the connecting link and also pivotally connected to the input bracket; and a pusher attached to the rocker link and configured to push on the piston when the rocker rotates.

In accordance with another embodiment of the present invention, a method of actuating a cylinder may be provided. The method may include: configuring a foot pedal to move an input lever; connecting an input bracket attached to the lever; fixing a bracket; pivotally connecting the fixed bracket to the input bracket; connecting a connecting link pivotally to the fixed bracket; connecting a rocker link; pivotally connecting the rocker link to the connecting link; pivotally connecting the rocker link to the input bracket; providing a pusher attached to the rocker link; and configuring the pusher link to push on the piston when the rocker rotates in a particular direction.

In accordance with another embodiment of the present invention, a foot actuated pivoting lever may be provided. The lever may include: a lever member having two ends, one end configured to attach to a mechanism configured to receive an input from the lever member; and means for extending a lever arm of the lever member pivotally attached proximate to the second end of the lever member, wherein the extending means is configured to pivot between a first and a second position, wherein in the first position, the extending means lies on top of a section of the lever member and in the second position the extending means extends beyond the lever member.

In accordance with yet another embodiment of the present invention, a mechanism for actuating a piston may be provided. The mechanism may include: means for inputting a force into the mechanism; an input bracket attached to the inputting means; a fixed bracket pivotally connected to the input bracket; a connecting link pivotally connected to the fixed bracket; a rocker link pivotally connected to the connecting link and also pivotally connected to the input bracket; and a pusher attached to the rocker link and configured to push on the piston when the rocker rotates.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
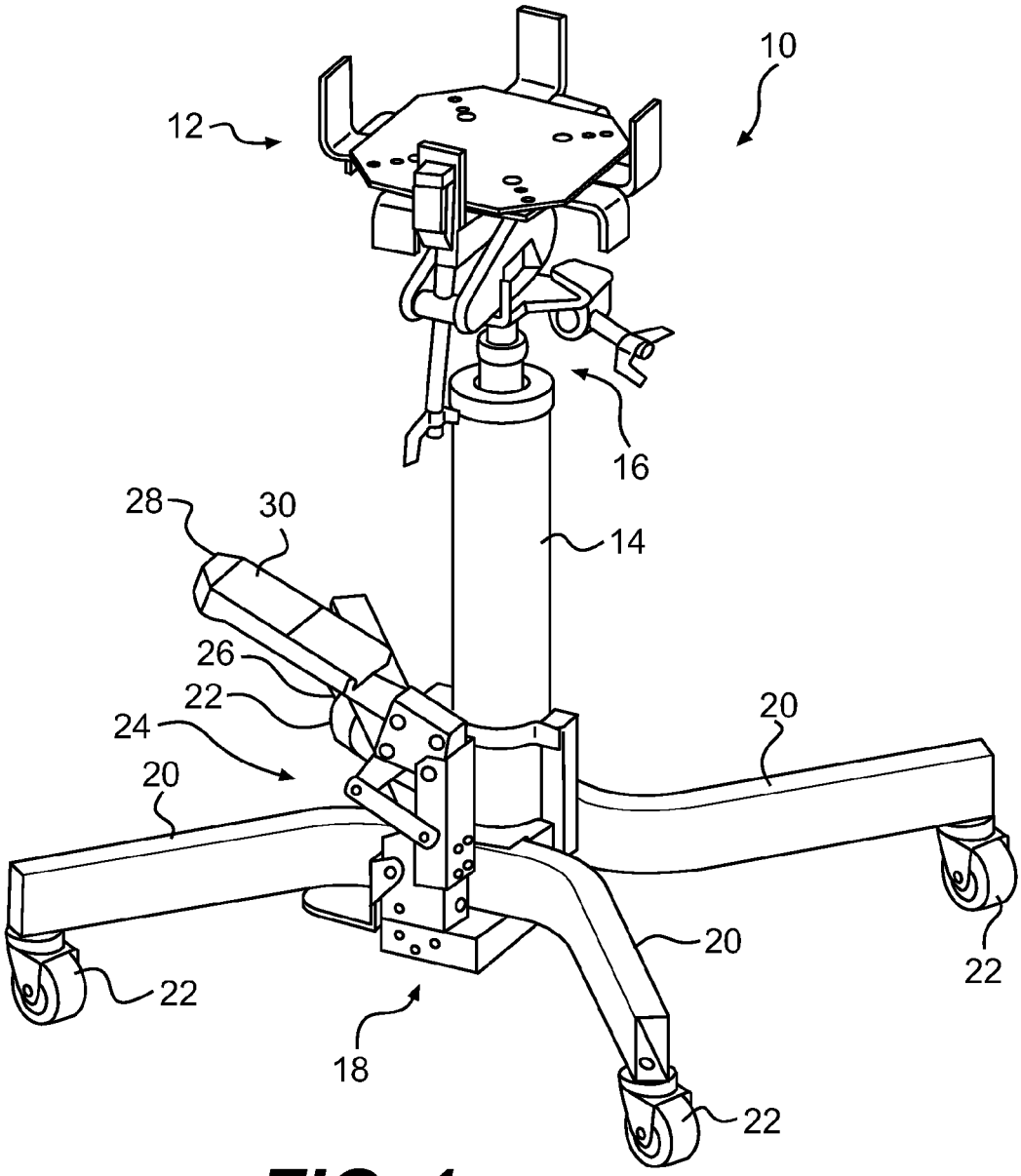
FIG. 1 is a perspective view of a transmission jack in accordance with an embodiment of the invention.

The invention will now be described with reference to the drawing figures, in which like reference numerals refer to like parts throughout. An embodiment in accordance with the present invention provides a transmission jack that has a foot pedal which operates a hydraulic piston to raise a jack.

An embodiment in accordance with the invention is shown in FIG. 1. The transmission jack 10 includes an attaching assembly 12. The attaching assembly allows the transmission jack 10 to attach to a transmission. The attaching assembly 12 is connected to a hydraulic jack 14 which includes lifting rods 16. The lifting rods 16 extend when hydraulic pressure is generated within a hydraulic jack 14. The extension of the lifting rods 16 raises the attaching assembly 12. The hydraulic jack 14 is attached to a frame 18. The transmission jack 10 includes legs 20 which have casters 22. The casters 22 allow the transmission jack 10 to be easily transported.

A linkage mechanism 24 is configured to provide a mechanical advantage to generate hydraulic pressure in order to raise the lifting rod 16 within the hydraulic jack 14. The linkage mechanism 24 includes an input bar 26. The input bar 26 may be made of rectangular tube stock steel as shown or may be of a variety of different materials and/or cross sections. The rectangular steel tube stock shown in the drawings is meant to be an example and is in no way limiting. The input bar 26 has a foot pedal 28 attached. The foot pedal 28 provides a wide platform for an operator to place his or her foot in order to press down on the foot pedal, and thus the input bar 26, to actuate the linkage mechanism 24. The foot pedal 28 includes an abrasive surface 30 or a skid reducing surface. The abrasive surface 30 allows the user's foot to be gripped by the abrasive surface 30 and, therefore, be less likely to slip off of the foot pedal 28.

The abrasive surface 30 can be a variety of surfaces. For example, it may be a sand paper like surface having a sticky back that is stuck on to the metal foot pedal 28. In other embodiments of the invention, foot pedal 28 may have a roughed surface machine cast, stamped, or otherwise impressed or imparted onto the foot pedal 28.

FIG. 1 shows the foot pedal 28 in a first position, where the foot pedal 28 is located on top of the input bar 26.

Figure 2:
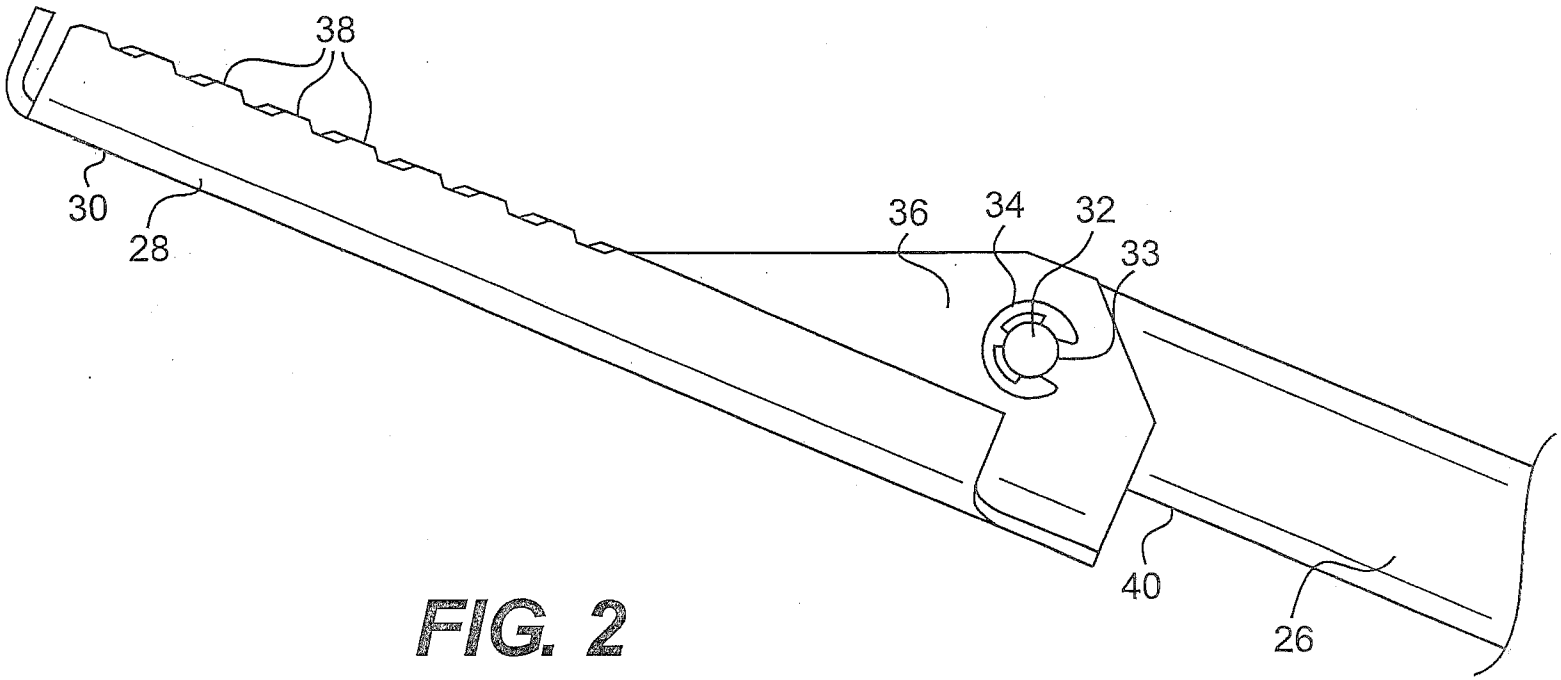
FIG. 2 is a partial side view of a portion of the transmission jack.

FIG. 2 is a side view of the foot pedal 28 in a second position. The foot pedal 28 is pivoted via the hinge pin 32 on the input bar 26. A hole 33 in the pedal permits the hinge pin 32 to connect the foot pedal 28 to the input bar 26. The hinge pin 32 is retained within the hole 33 and the pedal by a retaining clip 34. The retaining clips 34 may be standard e-shaped clips or other spring-type retaining clips commonly used for retaining hinge pin 32. The hinge pin 32 may include grooves (not shown) in which the retaining clips 34 may reside connect to the hinge pin 32.

The foot pedal 28 includes an attaching bracket 36. The attaching bracket 36 provides a wide portion and defines a hole 33 in which the hinge pin 32 can reside. The undersurface of the foot pedal 28 may include teeth 38. The purpose of the teeth 38 is similar to that of the abrasive surface 30, in that it allows a user's foot to contact the foot pedal 28 with a high degree of friction, thus, when a user's foot is pressing down onto the foot pedal 28, the user's foot or shoe is less likely to slip off of the foot pedal 28. When a user places his or her foot on the teeth 38 of the foot pedal 28 and pushes down, the foot pedal 38 exerts a downward force on the hinge pin 32 and an upward force upon the underside 40 of the input bar 26, thus creating a moment. The overall result is that the foot pedal 28 acts as an extension of the input bar 26 to effectively lengthen the lever arm and thereby increase the moment generated by the downward force on the foot pedal 28. Effectively, the length of the input bar 26 is combined with the length of the foot pedal 28, thereby increasing the moment exerted where the input bar 26 is pivotally connected to the linkage mechanism 24 (as shown in FIG. 1).

Figure 3:
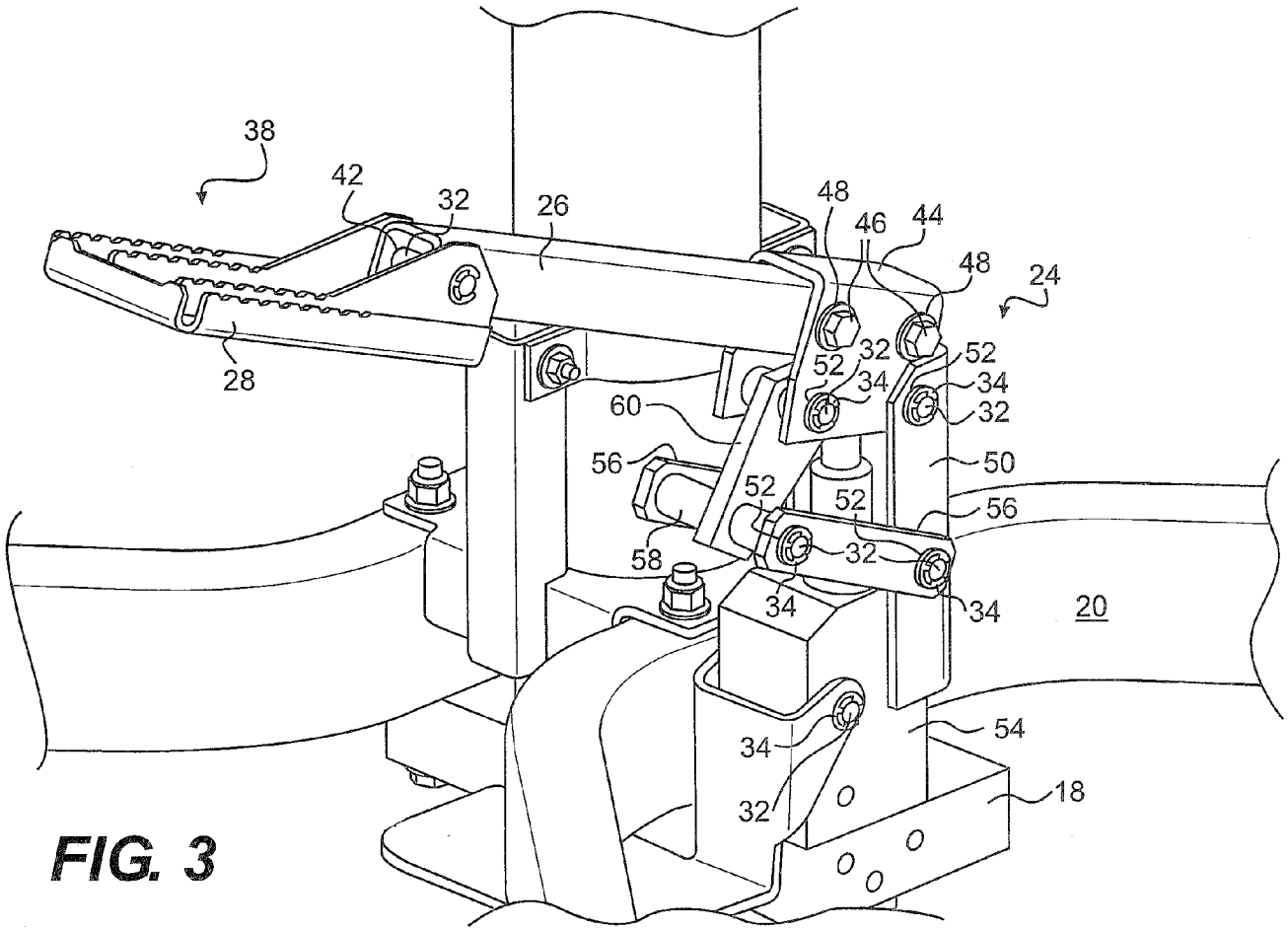
FIG. 3 is a partial perspective view of a portion of the transmission jack.
Figure 4:
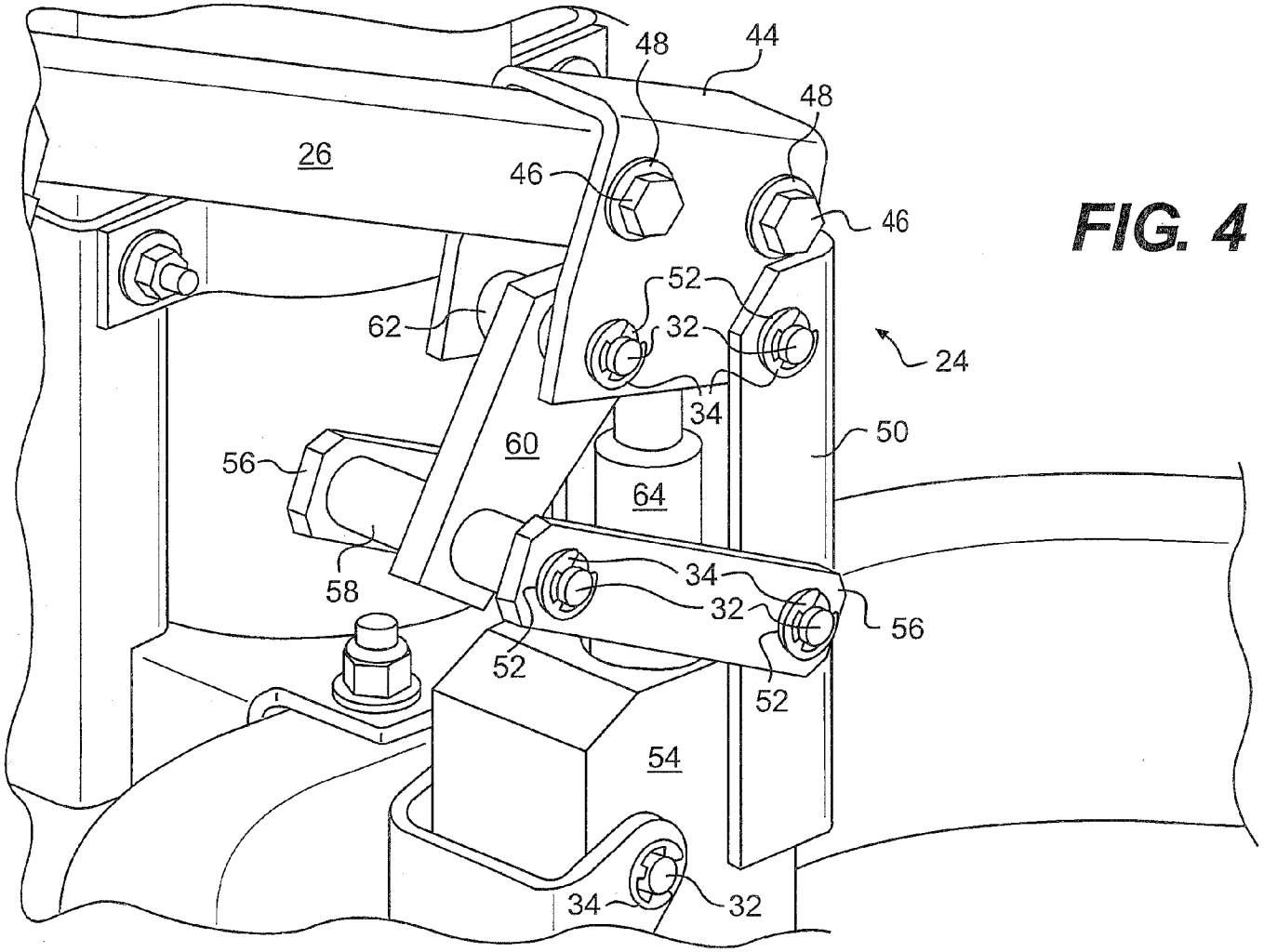
FIG. 4 is an enlarged isometric view of a portion of the transmission jack, showing the piston actuating mechanism.

FIG. 3 is a partial perspective view of the linkage mechanism 24. A hole 42 in the input bar 26 is shown and the hinge pin 32 is shown extending through the hole 42 into the input bar 26. The input bar 26 at the other end attaches to an input bracket 44. As shown in FIGS. 3 and 4, the input bar 26 attaches to the input bracket 44 via bolts and/or fasteners 46. The bolts and/or fasteners 46 may include washers 48. The input bar 26 does not pivot with respect to the input bracket 44 but rather when the input bar 26 pivots it causes the input bracket 44 to pivot with it.

The input bracket 44 is pivotally attached to a fixed bracket 50. The fixed bracket 50 is fixed or attached to the cylinder block 54. Cylinder block 54 is connected to or attached to the frame 18. Thus, the fixed bracket 50, in some embodiments of the invention, does not rotate.

Figure 5:
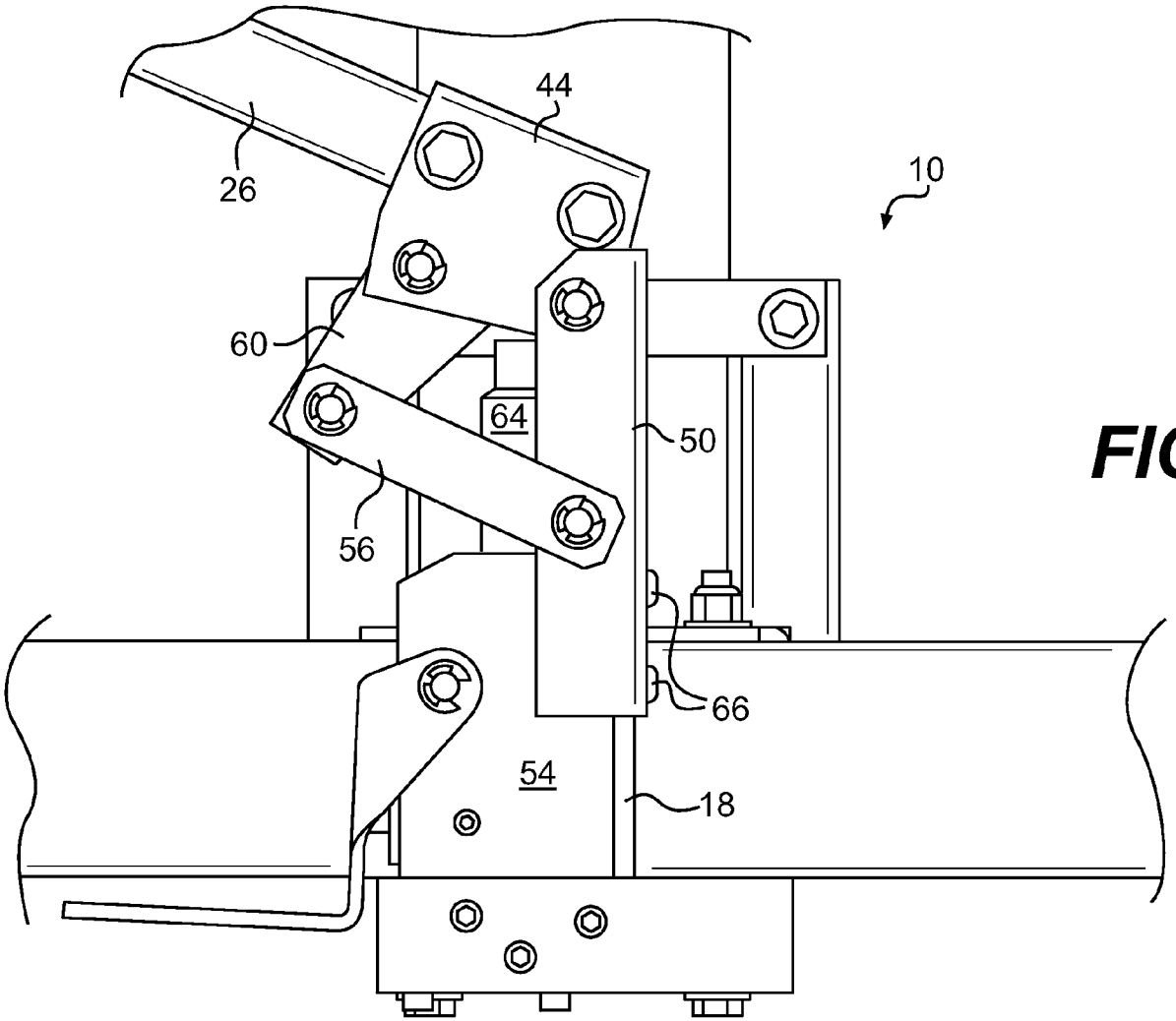
FIG. 5 is an enlarged side view of the piston actuating mechanism of the transmission jack.

The fixed bracket 50 is pivotally attached to a connecting link 56. The connecting link 56 may have a corresponding second connecting link also labeled 56 located opposite the first connecting link 56 as shown in FIGS. 3, 4 and 5. The pivoting connections within the linkage mechanism 24 may include hinge pins 32 held in place by retainer clips 34.

Bearings 52 may also be used in the pivot connections. A bearing 52 may be placed in joints containing the pivot connections. Bearings may be placed in joints, such as joints in the input bracket 44, fixed bracket 50 or the input link 56. The bearing 52 may reduce the friction of the hinge pin 32 rotating within the bearing 52. In some embodiments of the invention, the bearing 52 may be an oil impregnated bronze bearing which is commonly known and used in the art.

Figure 8:
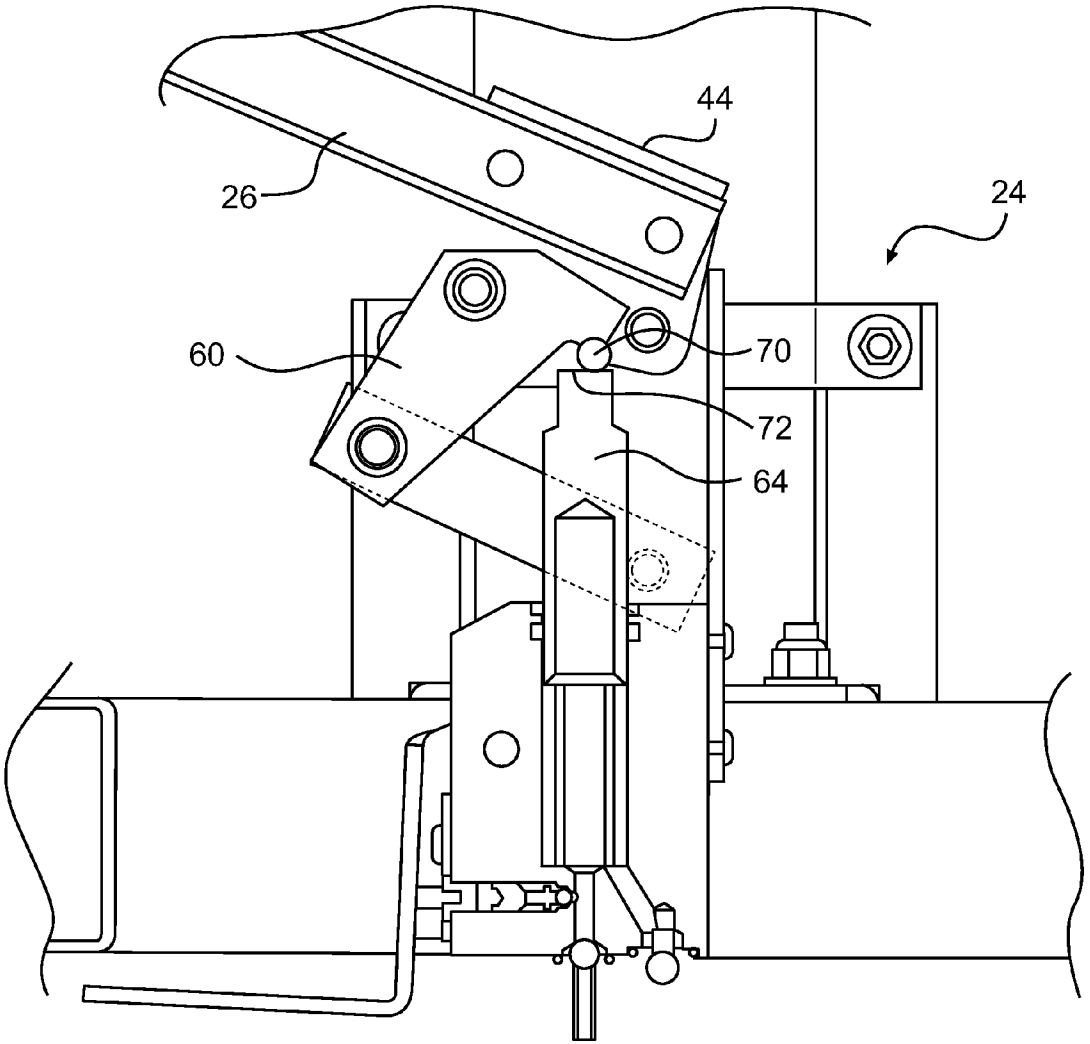
FIG. 8 is a cut away side view of the actuating mechanism for the transmission jack.

As shown in FIGS. 3 and 4 a connecting link 56 may be attached by a pivot rod 58 to a rocker link 60. As best shown in FIG. 4, the rocker link 60 may have a second pivot rod 62 which connects the rocker link 60 to the input link 44. As shown in FIGS. 4 and 8, a piston assembly 64 is actuated by the rocker link 60. As shown in FIG. 5, fasteners 66 may be used to attach the fixed bracket 50 to the frame 18 or to the cylinder block 54.

Figure 6:
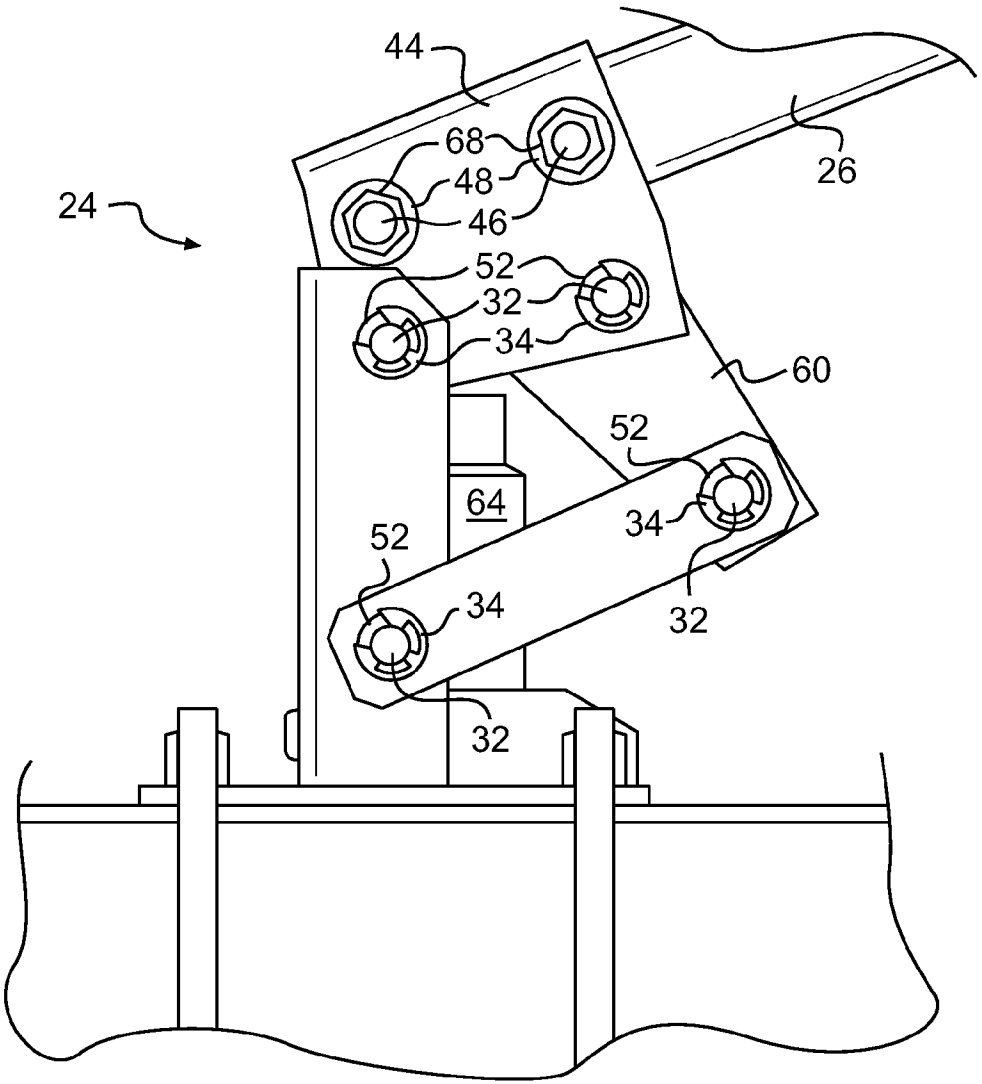
FIG. 6 is an enlarged rear view of the actuating mechanism for the hydraulic piston in the transmission jack.

FIG. 6 is a back side view of the linkage mechanism 24, showing many of the features already shown in the earlier figures. For example, the input bar 26 is shown connected to the input bracket 44. In FIG. 6, it can be seen that the bolts or fasteners 46 attach the input bar 26 to the input bracket 44 with washers 48 and hex nuts 68. The hinge pins 32 and retaining clips 34 as well as the bearings 52 on the input bracket 44, rocker link 60 and other locations on the linkage mechanism 24 can also be seen.

FIGS. 1-6 show the linkage mechanism 24 in a position where the input bar 26 is oriented to slope down toward the linkage mechanism 24. As a result of the orientation of the input bar 26, the various brackets and links 44, 50, 56 and 60 are shown in specific positions.

Figure 7:
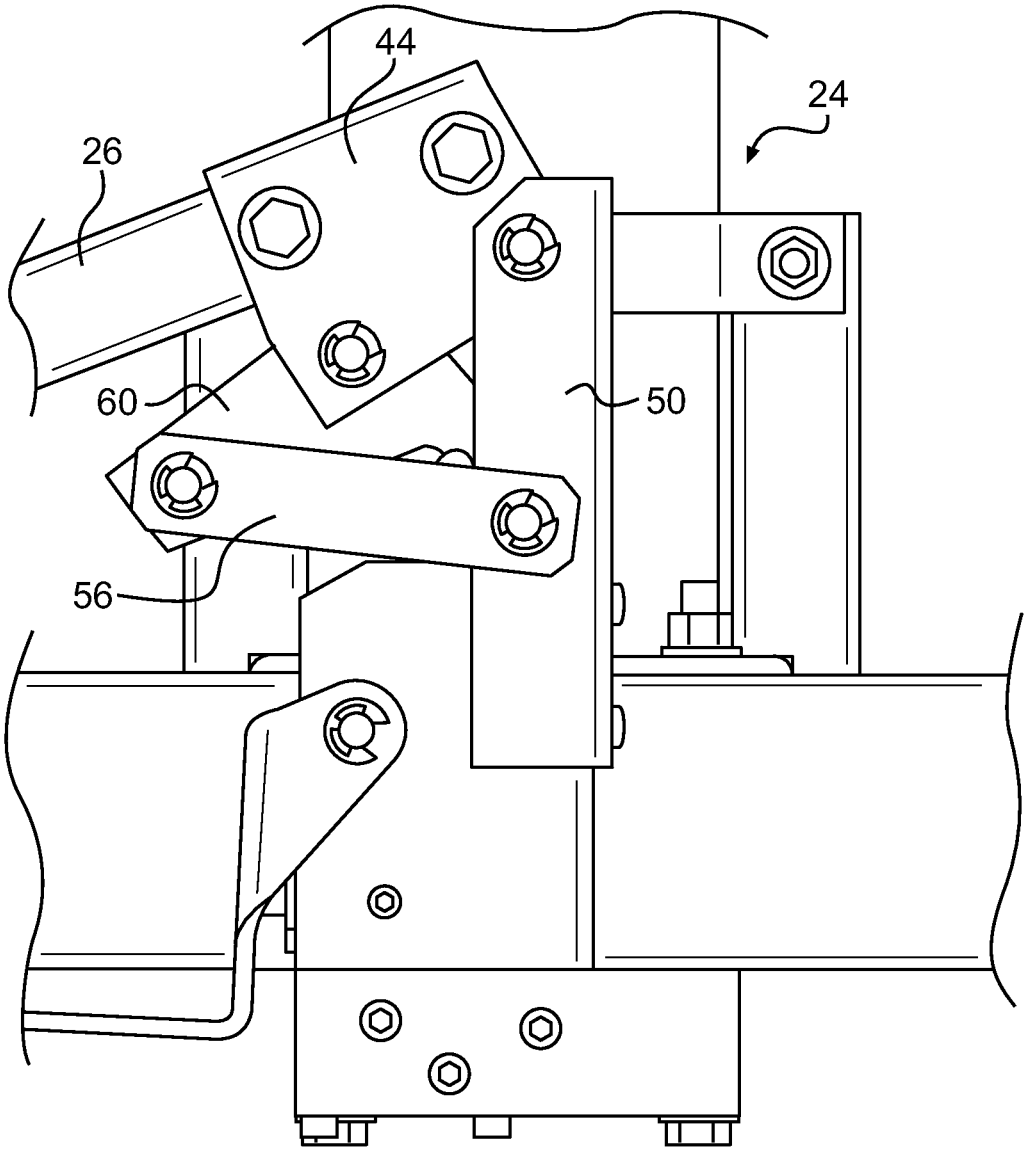
FIG. 7 is an enlarged side view of the actuating mechanism for the transmission jack.

FIG. 7 shows the input bar 26 in an opposite position than that shown in FIGS. 1-6. In other words, input bar 26 is now oriented so that the input bar slopes away from the input mechanism 24. The position of the input bar 26 as shown in FIG. 7 is consistent with the position an input bar 26 would be if a user stepped on the pedal 28. The change in orientation of the input bar 26 therefore changes the orientation of the input bracket 44, the connecting links 56 and the rocker link 60. Note that the fixed bracket 50 does not change its orientation as it remains fixed through the motion of the input bar 26 as it moves up and down.

FIG. 8 is a partial cut away side view of the linkage mechanism 24. The input bar 26 is shown connected to the input bracket 44. The rocker link 60 can be shown also connected to the input bracket 44 and connected to a pusher 70. The pusher 70 is configured to urge against a top flat surface 72 of piston assembly 64. Thus, as the rocker bar 26 moves down, the pusher link 60 pushes the pusher 70 in a downward direction, thereby actuating the hydraulic piston assembly 64 in a downward direction. The downward movement of the piston assembly 64 generates a hydraulic pressure in order to actuate the jack 14.

The pusher 70 has a generally rounded face and avoids inputting a shear force on to the piston assembly 64. The nature and geometry of the linkage mechanism 24 is such that the rocker link 60, for the most part, applies only a vertical force upon the piston assembly 64. The geometry of the pusher 70 helps reduce any residual right to left forces or, in other words, shear forces that may have been imparted by the rocker link 60 to the piston assembly 64, by merely moving to one side or the other of the piston assembly 64 as the rocker link 44 moves. Thus, primarily only vertical forces are imparted from the rocker link 60 onto the piston assembly 64.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A foot actuated pivoting lever comprising:

a lever member having two ends, one end of the two ends is configured to attach to a mechanism configured to receive an input from the lever member; and a pedal pivotally attached proximate to the other end of the two ends of the lever member, wherein the pedal is configured to pivot between a first position and a second position, and wherein in the first position, the pedal lies on top of a section of the lever member, and in the second position, the pedal extends beyond the lever member, wherein in the second position, the pedal is oriented on the lever member such that part of the pedal contacts an underside of the lever member such that a first downward force on the pedal causes a second downward force on a pivot point between the pedal and the lever member and an upward force on the underside of the lever.

2. The lever of claim 1, further comprising a skid reducing surface on a top part of the pedal for use when the pedal is in the first position.

3. A foot actuated pivoting lever comprising:

a lever member having two ends, one end of the two ends is configured to attach to a mechanism configured to receive an input from the lever member;

a pedal pivotally attached proximate to the other end of the two ends of the lever member, wherein the pedal is configured to pivot between a first and a second position, and wherein in the first position, the pedal lies on top of a section of the lever member, and in the second position, the pedal extends beyond the lever member;

a skid reducing surface on a first part of the pedal for use when the pedal is in the first position;

a skid reducing surface on a second part of the pedal for use when the pedal is in the second position;

wherein when the pedal is in the first position, the skid reducing surface on the second part of the pedal is closer to the end of the lever member configured to attach to the mechanism than the skid reducing surface on the first part of the pedal is when the pedal is in the first position.

4. The lever of claim 3, wherein the skid reducing surface includes teeth.

* * * * *